US006286529B1

(12) United States Patent
Olivera

(10) Patent No.: US 6,286,529 B1
(45) Date of Patent: Sep. 11, 2001

(54) SHOCK ABSORBER FOR CRUTCHES

(76) Inventor: Jorge Rehberger Olivera, Cabo Noval, 7 - 5° , E-33007 Oviedo (ES)

( * ) Notice: Subject to any disclaimer, the term of this patent is extended or adjusted under 35 U.S.C. 154(b) by 0 days.

(21) Appl. No.: 09/341,234

(22) PCT Filed: Nov. 6, 1997

(86) PCT No.: PCT/ES97/00265

§ 371 Date: Jul. 6, 1999

§ 102(e) Date: Jul. 6, 1999

(87) PCT Pub. No.: WO98/46186

PCT Pub. Date: Oct. 22, 1998

(30) Foreign Application Priority Data

Apr. 15, 1997 (ES) ..... 9700973 U

(51) Int. Cl.[7] ..... A61H 3/02; A45B 9/00
(52) U.S. Cl. ..... 135/82; 135/77
(58) Field of Search ..... 135/82, 68, 69

(56) References Cited

U.S. PATENT DOCUMENTS

| | | | | |
|---|---|---|---|---|
| 26,829 | * | 1/1860 | Bickel | 135/82 |
| 2,690,188 | | 9/1954 | Goddard . | |
| 2,802,479 | | 8/1957 | Hickman . | |
| 3,158,162 | | 11/1964 | Reel . | |
| 3,901,258 | | 8/1975 | Montgomery . | |
| 4,881,493 | | 11/1989 | Martel et al. . | |
| 4,958,651 | * | 9/1990 | Najm | 135/82 |
| 6,055,998 | * | 5/2000 | Bader | 135/69 |

FOREIGN PATENT DOCUMENTS

| | | | | |
|---|---|---|---|---|
| 165751 | * | 9/1949 | (AT) | 135/82 |
| 175137 | * | 2/1917 | (CA) | 135/82 |
| 0 513 411 | | 11/1992 | (EP) . | |
| 0 738 837 | | 10/1996 | (EP) . | |
| 371291 | * | 1/1907 | (FR) | 135/82 |
| 141109 | | 4/1990 | (GB) . | |

OTHER PUBLICATIONS 1 sheet having 5 figures from what appears to be a Great Britian Patent of unknown number, Jan. 1912.*

* cited by examiner

*Primary Examiner*—Robert Canfield
(74) *Attorney, Agent, or Firm*—Wenderoth, Lind & Ponack L.L.P.

(57) ABSTRACT

A device is provided for absorbing shock during use of crutches wherein are provided two telescopic tubes (6, 7) which, on the one hand, make possible adjusting the effective height of the crutch and, on the other hand, absorb the impact of the crutch to the ground. The device includes of a plug member (13) which is fitted to the upper extremity of the lower telescopic tube (6) and which has an elongate side hole (15) wherein a pin (11') can slide and is secured to the upper external tube (7), precisely through an orifice (12) drilled in the tube. The length of the elongate orifice (15) of the plug member limits the relative motion between the two tubes (6, 7) forming the strut (1). The elements are maintained at a maximum distance from each other by a spring (10) positioned between the plug member (13) and the second pin (11) of the upper external tube.

3 Claims, 1 Drawing Sheet

SHOCK ABSORBER FOR CRUTCHES

PURPOSE OF THE INVENTION

This invention relates to a shock absorber for crutches. With it, crutches offer the best conditions regarding user's comfort through a damped support on the ground. The device has been conceived and arranged in order to arrive at a considerable reduction in price of the crutch.

BACKGROUND OF THE INVENTION

Utility model number 9601865, from the same applicant, describes a crutch with which several problems and difficulties are solved. These derive from the frame-work or basic constitution of traditional crutches, whether they are finished off by a cross-piece made to be adapted to the armpit of the user, or they are those where the upper end is finished off by a semi-clamp to be adapted on its side to the arm, close to the user's elbow.

Therefore, in the utility model, the novelty of the crutch is described as being the structure between the traditional cross-piece for the support of the user's hand, and the lower end for the support of the crutch on the ground. The structure is characterized by a telescopic strut, based on two sectors that are axially interconnected. So, the lower sector or span acts as a female element while the upper sector or span acts as a female element while the upper sector or span acts as a male element, with the particularity that between both sectors or spans and internally, a bumper is placed to absorb the effects of the crutch impact on the ground, when walking, and more precisely, the effects that the impact produce on the member which is holding it down and which is transmitting the corporal weight to it.

This solution avoids the typical "shock" at the upper extremities of people using crutches to walk, which "shock" effect can produce pathological irregularities in the individual, such as the so-called "crutch syndrome" and which is characterized by neurological irregularities in the arms, caused by the injury of the brachial plexus when passing through the armpit region.

Logically, structure characteristics of the crutch, which is the object of the utility model 9601865, with regard to its telescopic capability and its bumper device incorporated by the lower strut of the crutch itself avoid or solve the troubles we just have explained.

Trying to improve the features of this kind of crutch, the applicant himself is the holder of utility model 9700973 in which, starting from a configuration similar to the one of the utility model 9601865 previously quoted, it has been foreseen that the damping itself could be controlled as a result of providing a spring capable of being arranged so as to have a larger or smaller degree of extensibility. Also, this damping can be canceled without needing to pull out the spring but rather by changing the position of a pin, which pin not only serves as a fixing part for connecting the two pipes that constitute the lower strut of the crutch, but also makes possible the damping because this pin is placed in a vertically extended window of the lower, internal pipe of the two pipes making up the lower strut of the crutch.

This solution, which is suitable from a functional point of view, represents in any case, an economical problem due to the costs for providing the extended window in the pipe making up the strut.

DESCRIPTION OF THE INVENTION

The device proposed by the invention, starting from a performing philosophy of the utility model 9700973, solves in a completely satisfactory way, the troubles explained above as it makes unnecessary any kind of machining in the pipe forming the strut.

For this and in a more concrete way, taking into consideration that it is necessary to "fit in" the upper end of that strut a cap provided with an axially upwardly extending rod to guide the spring that supplies the crutch with the bumper effect, this invention is characterized by extending the body of the cap to enable establishment of the elongated window or hole therein to absorb the telescopic motion of the strut against the elastic deformation of the spring, as well as a hole necessary to cancel the bumper effect through a position change of the corresponding pin.

In this way and as it has been said above, the pipe forming the strut does not require any machining, and the part forming the cap, as it has been obtained from plastic material and through injection, has a cost nearly the same, with or without the holes. Therefore, the economic repercussion that the presence of these parts represents, is no more than the necessary material costs for its extension, and this material cost is considerably lower than the former costs of the pipe machining.

DESCRIPTION OF THE DRAWINGS

In order to complete the description which is being made and with the aim of helping to a better understanding of the characteristics of the invention, according to a preferable example of its practical realization, it is enclosed as an integral part of that description, a set of drawings where, on an illustrative and not restrictive basis, it has been represented what follows.

PREFERRED EMBODIMENT OF THE INVENTION

Figure 1:
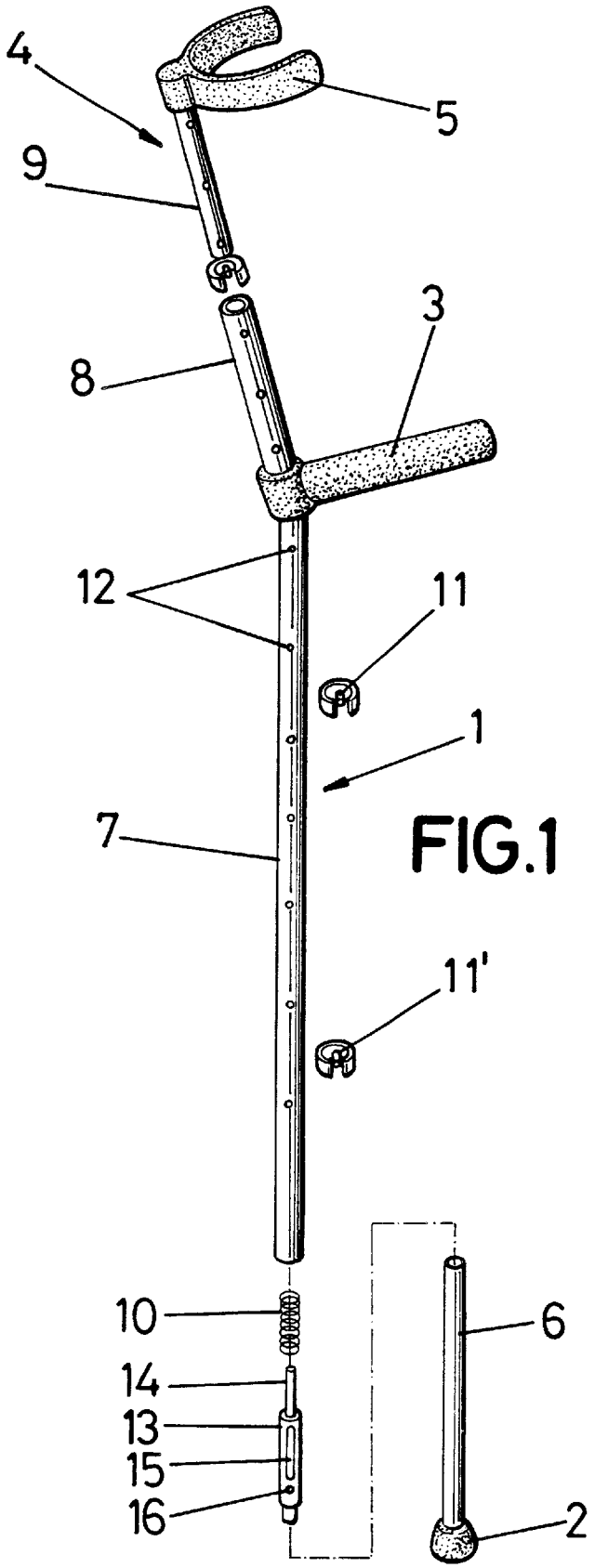
FIG. 1 shows an exploded perspective view of a crutch provided with a bumper device according to the present invention.

From these figures it can be observed that this crutch includes a lower strut (1), finished off at its end with a shoe or a non-slipping rubber plug (2), as a support element on the ground. The lower strut (1) is straight and incorporates an upper cross-piece (3) for the support of the user's hand. From the cross-piece is extended a second span (or upper strut) (4) which is not very long and follows an oblique path with regard to the lower strut. This second span is finished off by a typical semi-clamp (5) adapted to receive the user's arm, close to this elbow.

The lower strut (1) is formed of two pipe sections (6) and (7) interconnected in a telescopic way, and the upper strut (4) is formed of two pipe sections (8) and (9), with the pipe (8) being the external one and the pipe (9) being the internal one, but the former remaining in an upper disposition.

The two pipe sections (6) and (7) of the lower strut (1) telescopically slide between limit positions, against the stress of a spring (10) supported on the top by a pin (11), operatively established in one of the many holes (12) of the pipe (7), and supported on the other end by a cap (or plug member) (13), connected to the upper end of the pipe (6) and provided with a rod or axial extension (14) serving as a guide for that spring (10). A second pin (11') holds together the two pipes (6) and (7) which make up the lower strut (1).

Figure 2:
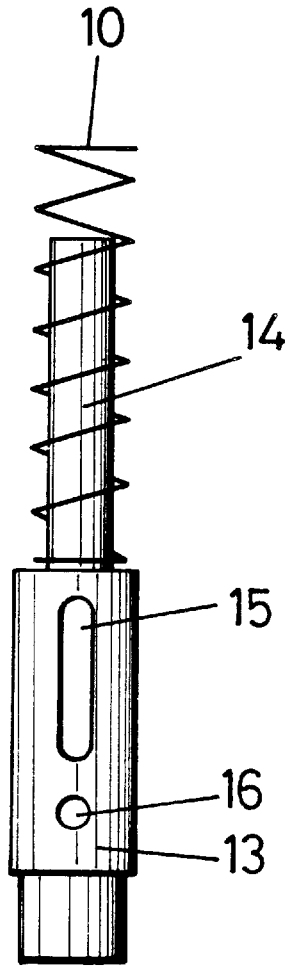
FIG. 2 shows an enlarged detail and side elevation of the bumper device of this invention.

Starting from this basic and conventional structure, this invention focuses on how the pipe (6) is related to the pipe (7) by the pin (11'). As best seen in FIG. 2, the cap (13) incorporates a transverse, longitudinally elongated hole (15), in which the pin (11') can slide, and a circular hole (16) in which the pin (11') can be introduced when it is desired to block relative telescoping movement of the two pipes (6) and (7) that make up the strut (1). In this way, the bumper effect (or shock-absorbing) can be eliminated without eliminating the spring (10).

In this way, the holes (15) and (16), which previously had to be machined in the lower pipe (6), can be formed in the injection formation of the cap (13) itself, thereby realizing a reduction in costs.

It is not considered as necessary to make this description more extensive in order that any expert in this matter could understand this invention and the advantages derived from it.

Materials, shape, size and positions of the elements could be changed when it will not represent an irregularity in the essence of this invention.

The terms used in this specification should always be taken in a broad and not restrictive sense.

What is claimed is:

1. A shock absorber for a crutch having a lower strut formed of upper and lower telescopically connected pipes, the upper pipe having diametrical holes, a pin disposed in a selected one of the diametrical holes of the upper pipe, and a spring operatively supported between the lower strut and the pin to provide shock absorbing during telescopic movement of the lower pipe relative to the upper pipe, wherein said shock absorber comprises:

a plug member attachable to a top end of the lower pipe and having an upwardly extending axial guide rod for receiving the spring thereon, said plug having formed therein an axially elongated hole and a non-axially elongated hole; and a lower pin member selectively engageable in a shock-absorbing position in which said lower pin member is fixed relative to the upper pipe and extends into said axially elongated hole of said plug member to allow play between said plug member and the upper pipe, and in a non-shock-absorbing position in which said lower pin member is fixed relative to the upper pipe and extends into said non-axially elongated hole of said plug member to prevent play between said plug member and the upper pipe.

2. A shock absorber according to claim 1, wherein said lower pin member is selectively engageable in the diametrical holes of the upper pipe, such that, in said shock-absorbing position, said lower pin member is engaged in one of the diametrical holes of the upper pipe and extends into said axially elongated hole of said plug member, and in said non-shock-absorbing position, said lower pin member is engaged in one of the diametrical holes of the upper pipe and extends into said non-axially elongated hole of said plug member.

3. A shock absorber according to claim 1, wherein said non-axially elongated hole is a circular hole.

* * * * *